US005324026A

United States Patent [19]

Conlon et al.

[11] Patent Number: 5,324,026

[45] Date of Patent: Jun. 28, 1994

[54] BASKETBALL TRAINING DEVICE

[76] Inventors: Timothy Conlon, 28 E. 9th St., Derby, Conn. 06418; Charles Stochmal, 8 Dolan Cir., Seymour, Conn. 06483

[21] Appl. No.: 89,806

[22] Filed: Jul. 9, 1993

[51] Int. Cl.[5] ..... A63B 69/00

[52] U.S. Cl. ..... 273/1.5 A

[58] Field of Search ..... 273/1.5 A, 189 R

[56] References Cited

U.S. PATENT DOCUMENTS

| | | | |
|---|---|---|---|
| 2,690,911 | 10/1954 | Newgren | 273/189 R |
| 3,415,524 | 12/1968 | Vickers | 273/189 R |
| 3,429,571 | 2/1969 | Abel, Jr. | 273/189 R |
| 3,820,783 | 6/1974 | Caveness | 273/1.5 A |
| 4,383,685 | 5/1983 | Bishop | 273/1.5 A |
| 4,717,149 | 1/1988 | Juhl | 273/1.5 A |
| 5,135,217 | 4/1992 | Swain | 273/1.5 A |

*Primary Examiner*—Paul E. Shapiro

*Attorney, Agent, or Firm*—Collard & Roe

[57] ABSTRACT

A basketball training device includes an upright housing stand having a right side wall a spaced distance from the left side wall, a front end wall connecting together the right side wall to the left side wall at the front of the stand, and a back end wall connecting together the right side wall to the left side wall at the back for the stand. A swing arm mechanism is attached to either the right side wall for the stand or the left side wall of the stand, at the front of the stand. Also, there is an elbow harness to be attached to the arm of the person using the training device to shoot a basketball. Thus, whenever the training device is worn by a basketball player to aid the player in developing a good basketball shot the basketball player will develop an arm motion during the basketball shooting in which the elbow is moved only in a straight up-and-down direction, which the proper way for shooting.

11 Claims, 3 Drawing Sheets

BASKETBALL TRAINING DEVICE

BACKGROUND OF THE INVENTION

1. Field of the Invention

The present invention relates to a basketball shooting practice device designed to facilitate the training and execution of proper basketball shooting techniques. Although the device hereof is particularly useful for free throw shooting practice, all basketball shooting efforts are enhanced through practice using the device.

2. The Prior Art

Coaches are noticing that college basketball games are showing a 4% reduction, versus 10 years ago, in accuracy in shooting one-handed foul shots. Students are incorrectly learning how to handle the basketball. Apparently, in shooting a foul shot, the arm should not twist, but come straight up as the elbow opens and the arm becomes straight and the ball is released.

Attempts in the past have failed to solve these problems, and prior proposals are as follows.

The Bishop U.S. Pat. No. 4,383,685 discloses a training aid for basketball players, consisting of a vest and elastic sleeve worn by the user and an arcuate guide bar disposed between the vest and elastic sleeve member. The arcuate guide bar is mounted on a pivot stub located on either side of the vest near the user's waist (i.e., depending on whether a left- or right-handed person is using the apparatus). The arcuate guide bar is then secured to a bracing element which, in turn, is secured to either side of the front of the vest, again depending on the dexterity of the user. The bracing element holds the guide bar in a secure position such that when the elastic sleeve (now worn by the user) is secured to it, only the limited movement necessary for a basketball shot is allowed. The elastic sleeve and the arcuate guide bar are shown in two embodiments. The first embodiment shows the use of a solid guide assembly and a collar-like carriage with rollers which engages around the arcuate guide bar and provides the limited motion desired by the apparatus. The second embodiment shows the use of an arcuate guide bar provided substantially centrally of its radial dimension with an elongated slot or guide track which is engaged by a cylindrical stud member attached to the elastic sleeve. The apparatus in either embodiment can be adjusted according to the measurements of the user in addition to accommodating the dexterity of the user (i.e., left-handed or right-handed users).

The Caveness U.S. Pat. No. 3,820,783 discloses a basketball training apparatus worn by the user consisting of three straps for securing the apparatus to the user. One strap around the waist, a second around the lower chest region, and a third connected to the latter in the front center of the user and extending around the user's neck will prevent any unwanted displacement of the apparatus during use. The lower and upper straps of the body are connected by a securing plate, whereby a guide arm is disposed. A sector plate with a plurality of holes for adjusting the location of the guide arm with respect to the dimensions of the user is connected to the sector plate. A transverse gauge arm is disposed perpendicular to the guide arm. The location of the transverse arm with respect to the guide arm depends upon the size of the user. The transverse arm serves to tell the user at what height the extension of the forearm should occur. If the user tries to extend the forearm too soon, the transverse arm will interfere with his/her motion. The apparatus is designed to accommodate both left- and right-handed individuals. Both the guide and transverse arms are adjustable in their relative positions.

The Swain U.S. Pat. No. 5,135,217 discloses a basketball training device worn by the user on the shooting hand and arm. A flexible arm band, approximately three inches in width, is worn on the upper arm of the user above the elbow and is secured by a buckle assembly. Attached to the arm band is an elastic band of adjustable length, the end of which has disposed a rigid finger harness which receives the index and middle finger of the user. The wrist of the user is held in the proper cocked position prior to shooting and returned back to that position when shooting is complete.

The Juhl U.S. Pat. No. 4,623,148 and the Juhl U.S. Pat. No. 4,717,149 each disclose a free throw shooting practice device consisting of a basketball rotationally coupled to an elongated support arm. The support arm is pivotally mounted to the frame of the apparatus. A shock absorber-like device, for cushioning the gravity-induced pivoting of the arm after a shot is taken, is connected to the support arm at the upper end and to the apparatus frame at the lower end. A pair of laterally spaced plates with an interconnecting bight serves as a shooting arm guide which is adjacent to and below the rotationally mounted basketball. The shooting arm guide is either mounted to the support arm or to the frame of the apparatus, depending on whether the standing or sitting embodiment, respectively, is used. When standing, the shooting arm guide moves out of the way when the shot is taken relative to the position of the support arm. The shooting arm guide, equipped with an elbow pad, serves to maintain the user's arm in the proper position for shooting. In addition to the shock absorber resistance provided, receiving elements for annular weights are provided on the support arm to increase the resistance. Two weight placements are provided, one to increase resistance, and one for counterbalance weight. The apparatus can accommodate both the left- and right-handed individual by providing a receiving end of the support arm designed to receive and lock the rotationally mounted ball in opposite orientations with respect to the rotational mounting equipment on the ball itself.

SUMMARY OF THE INVENTION

It is an object of the present invention to provide a training device for basketball players for developing proper shooting technique.

It is another object of the present invention to provide a method for training and a training aid for basketball players which is worn by the player and which serves to train the player to keep his elbow straight and to ensure that the elbow of the player is moved only in a straight line, up-and-down direction which is the proper way for shooting a basket in the game of basketball.

It is a further object of the invention to provide a training device for use by basketball players which is worn by the player and which is adapted for user by either a right-handed or left-handed player.

The above objects are accomplished in accordance with the present invention by providing a basketball training device comprising an upright housing stand having a right side wall a spaced distance from the left side wall, a front end wall connecting together the right side wall to the left side wall at the front of the stand, and a back end wall connecting together the right side wall to the left side wall at the back of the stand. A swing arm mechanism is attached to one of the right side walls of the stand or the left side wall of the stand at the front of said stand. An elbow harness is attached to the arm of the person using the training device to shoot a basketball, so that whenever the training device is worn by a basketball player to aid the player in developing a good basketball shot, the basketball player will develop an arm motion during the basketball shooting in which the elbow is moved only in a straight up-and-down direction, which is the proper way for shooting.

BRIEF DESCRIPTION OF THE DRAWINGS

Other objects and features of the present invention will become apparent from the following detailed description considered in connection with the accompanying drawings which discloses embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
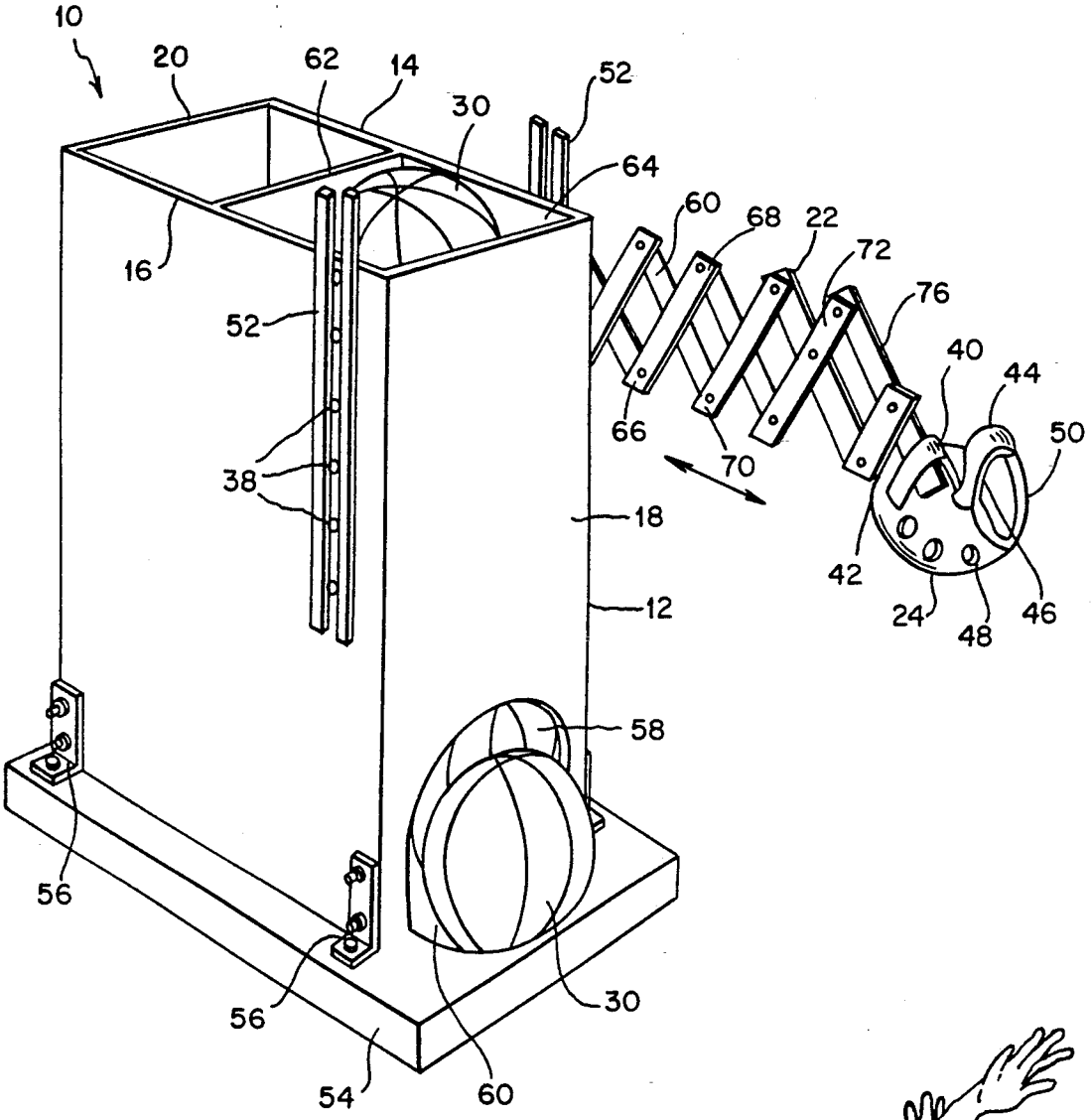
FIG. 1 shows a front perspective view of the basketball training device according to the present invention.

Turning now in detail to the drawings, FIG. 1 shows a basketball training device 10 comprising an upright housing stand 12 having a right side wall 14 a spaced distance from the left side wall 16, a front end wall 18 connecting together the right side wall 14 to the left side wall 16 at the front of stand 12. There is also a back end wall 20 connecting together the right side wall to the left side wall at the back of the stand. A swing arm mechanism 2 is attached to one of either the right side wall 14 of the stand or the left side wall 16 of the stand, at the front of the stand 12. As shown in FIG. 4, there is an elbow harness 24 to be attached to the arm 26 of the person 28 using the training device to shoot a basketball 30.

Figure 4C:
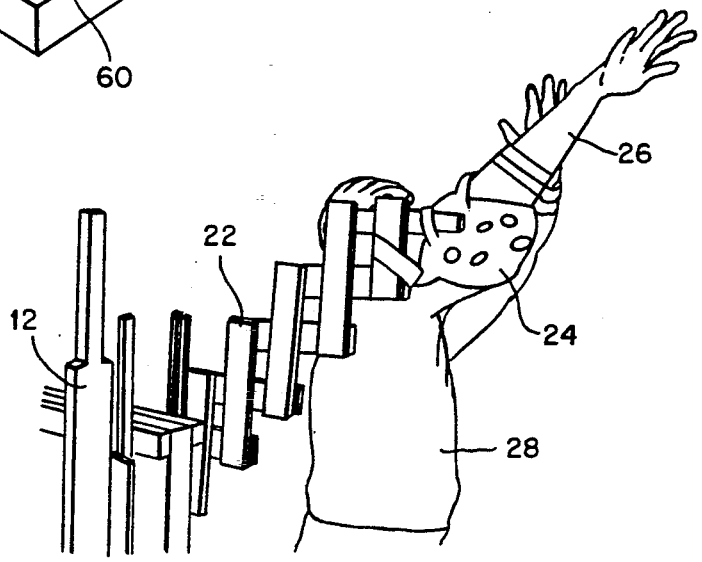
FIG. 4C shows a side perspective view of the basketball training device of FIG. 1 in use with the elbow harness attached to the person's right arm in an upward extended position.
Figure 4A:
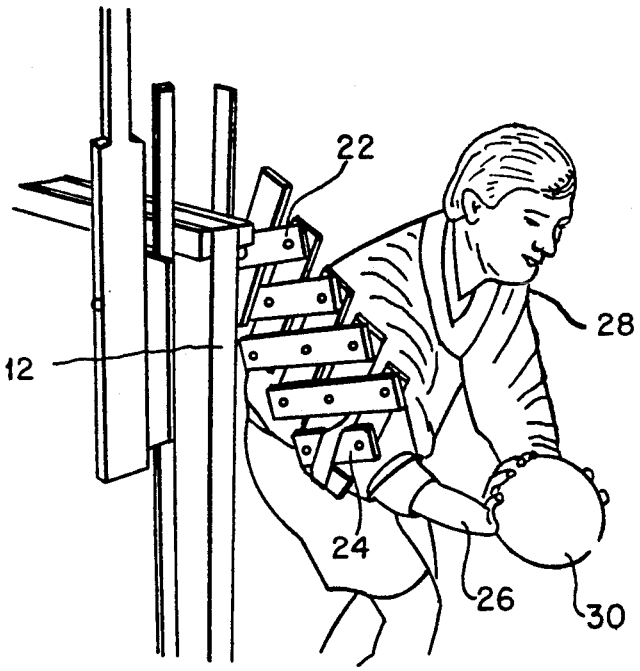
FIG. 4A shows a front perspective view of the basketball training device of FIG. 1 in use with the elbow harness attached to the person's right arm in a lowered position.
Figure 4B:
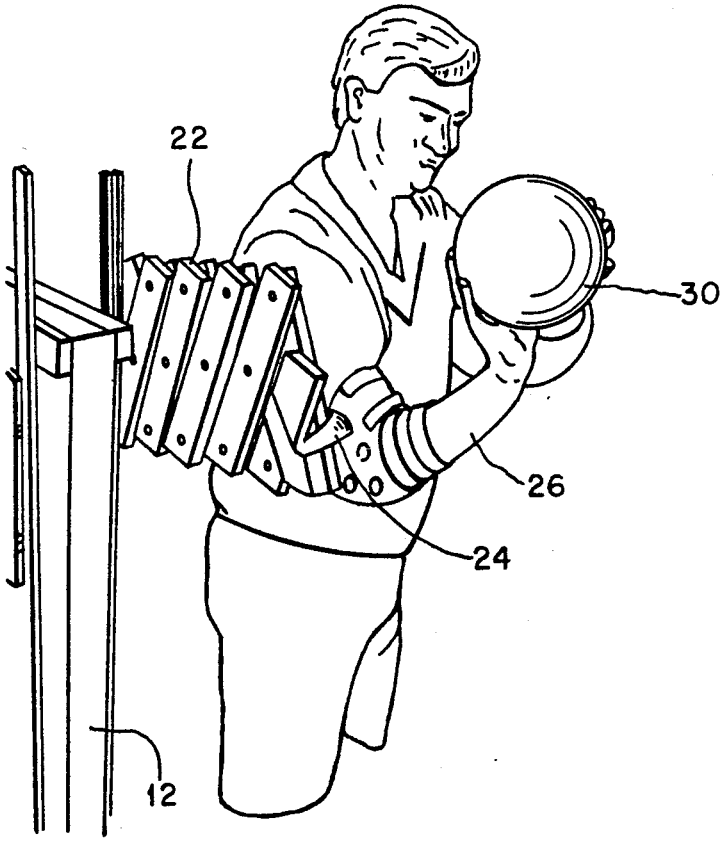
FIG. 4B shows a front perspective view of the basketball training device of FIG. 1 in use with the elbow harness attached to the person's right arm in an intermediate position.

Hence, whenever the training device is utilized by a basketball player to aid the player in developing a good basketball shot, the basketball player will develop an arm motion during the basketball shooting in which the elbow is moved only in a straight up-and-down direction, which is the proper way for shooting, as shown in FIGS. 4A, 4B and 4C.

Figure 2:
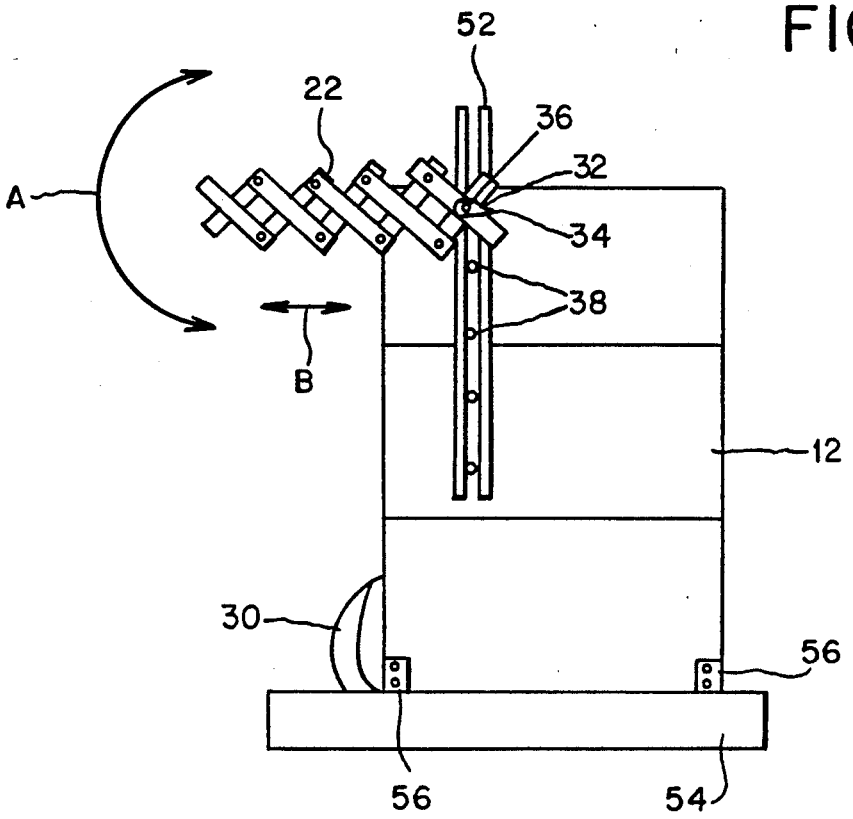
FIG. 2 shows a right side view of the basketball training device of FIG. 1 having one embodiment of the swing arm mechanism.
Figure 3:
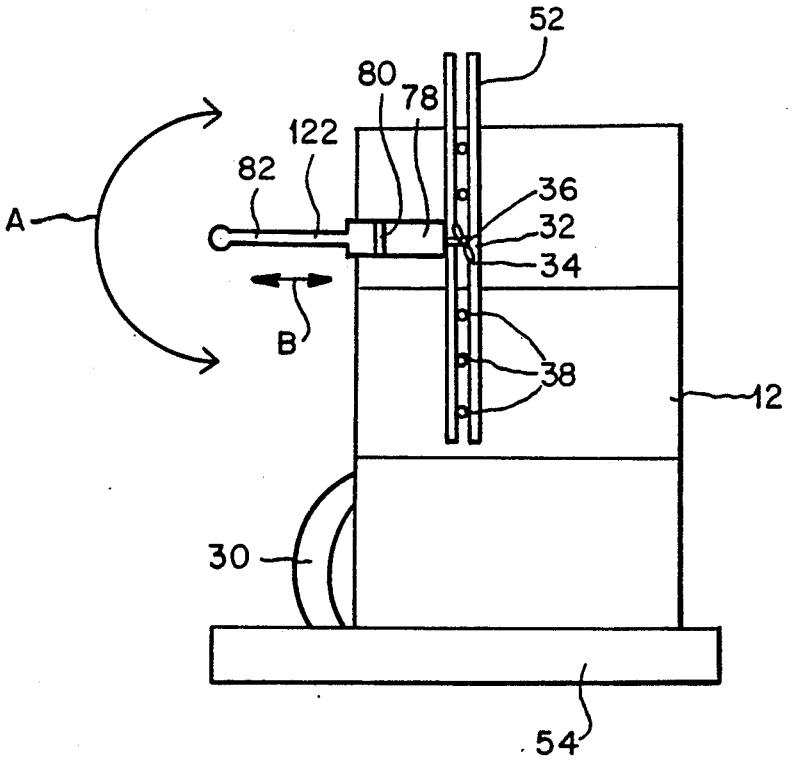
FIG. 3 shows a right side view of the basketball training device of FIG. 1 showing another embodiment of the swing arm mechanism.

As shown in FIGS. 2 and 3, there is a connecting means 32 for attaching the swing arm mechanism 22 to the stand. In FIG. 3, the swing arm mechanism 122 is a modification of the mechanism shown in FIG. 2. The swing arm mechanism 22 or 122 is rotatable around the connecting means 32 as indicated by arrow A. The connecting means includes a cross tie 34 that has an opening through which a pin 36 is placed. Mechanism 22 or 122 has a corresponding opening therein that is aligned with the cross tie opening and a corresponding opening 38 in the side wall 14 or 16. Hence, pin 36 is inserted through opening 38 and fixed therein by a screw threaded nut to permit motion by mechanism 22 or 122. Thus, the swing arm mechanism is extendable outwardly away from the connecting means, and the swing arm mechanism is retractable inwardly toward the connecting means as indicated by arrow B.

The elbow harness 24 comprises attachment means 40, such as a VELCRO® hook and loop fastener at a first end 42 for connecting the elbow harness to the swing arm mechanism and a collar means 44 such as a VELCRO® hook and loop fastener at a second end 46 for releasably holding the arm 26 of the user 28 tightly in place during use of the device. There are also air vent openings 48 in the elbow harness along with padding 50 for the comfort of the user.

There is a vertical channel means 52 positioned on one or both of side walls 14 and 16 and within which the connecting means 32 is vertically displaceable and within which the connecting means 32 is attached to the side wall through the openings 38.

A bottom wall 54 upon which the housing stand 12 is positioned supports the stand, and there is a means 56 for connecting the stand to the bottom wall. Means 56 includes an angle iron having screw threaded bolts therethrough for fastening together the side walls 14 and 16 to the bottom wall 54.

The front wall 18 adjacent to the bottom wall 54 has an opening 58 through which basketballs 30 are dispensable. The bottom wall has a scooped out concave depression 60 aligned with opening 58 in the front wall in order to hold the basketballs 30 in position until the shooter removes the next basketball in the series. Middle wall 62 is a vertically extending wall that is parallel to the front wall 18 and is a spaced distance therefrom so as to create a basketball holding zone chamber 64 into which several basketballs can be vertically stacked. Wall 62 extends from bottom wall 54 upwardly. These basketballs are guided by wall 54 downwardly to depression 60 and to opening 58.

The embodiment of the swing arm mechanism 22 shown in FIG. 2 is an accordion-like arm made of rectangular elements 66 that are pinned to one another at the top end 68, the bottom end 70 and in the middle 72 so as to be swingable. The rectangular elements comprise two sets of parallel rows 74 and 76.

The embodiments of the swing arm mechanism 122 shown in FIG. 3 is a piston cylinder in which cylinder 78 is attached to stand 12. Within cylinder 78 is piston 80 to which is attached movable arm 82 to which elbow harness 24 would be connected, as shown in FIG. 1.

FIG. 4A shows a front perspective view of the basketball training device 10 of FIG. 1 in use with the elbow harness 24 attached to the person's right arm 26 in a lowered position holding the basketball 30 preliminary to shooting a foul shot. FIG. 4B shows a front perspective view of the basketball training device 10 of FIG. 1 in use with the elbow harness 24 attached to the person's right arm 26 in an intermediate position, and also preliminary to shooting a foul shot. FIG. 4C shows a side perspective view of the basketball training device of FIG. 1 in use with the elbow harness attached to the person's right arm in an upward extended position after taking the foul shot.

While several embodiments of the present invention have been shown and described, it is to be understood that many changes and modifications may be made thereunto without departing from the spirit and scope of the invention as defined in the appended claims.

What is claimed is:

1. A basketball training device comprising an upright housing stand having a right side wall a spaced distance from the left side wall, a front end wall connecting together said right side wall to said left side wall at the front of said stand, and a back end wall connecting together said right side wall to said left side wall at the back of said stand;

a swing arm mechanism attached to one of said right side wall of said stand or said left side wall of said stand, at the front of said stand; and an elbow harness to be attached to the arm of the person using the training device to shoot a basketball.

2. The basketball training device of claim 1, further comprising connecting means for attaching said swing arm mechanism to said stand.

3. The basketball training device of claim 2, further comprising means for rotating said swing arm mechanism around said connecting means.

4. The basketball training device of claim 3, further comprising means for extending said swing arm mechanism outwardly away from said connecting means, and means for retracting said swing arm mechanism inwardly toward said connecting means.

5. The basketball training device of claim 2, further comprising a vertical channel means positioned on one of said side walls within which said connecting means is vertically displaceable and within which said connecting means is attached to said side wall.

6. The basketball training device of claim 1, wherein said elbow harness comprises attachment means at a first end for connecting said elbow harness to said swing arm mechanism and comprises collar means at a second end for releasably holding the arm of the user tightly in place during use of the device.

7. The basketball training device of claim 1, further comprising a bottom wall upon which said housing stand is positioned; and means for connecting said stand to said bottom wall.

8. The basketball training device of claim 7, wherein said front wall adjacent to said bottom wall has an opening through which basketballs are dispensable.

9. The basketball training device of claim 1, wherein said swing arm mechanism comprises an accordion-like arm made of rectangular elements that are pinned to one another at a top end of the element, at a bottom end of the element and in a middle of the element.

10. The basketball training device of claim 1, wherein said swing arm mechanism comprises an accordion-like arm consisting of rectangular elements, each having a top end, a spaced bottom end and an intermediate middle spaced from the top and bottom ends, the elements being pinned to each other in succession at the top end of the element, at the bottom end of the element and in the middle of the element.

11. The basketball training device of claim 1, wherein said swing arm mechanism comprises a piston cylinder attached to said stand, said cylinder having a piston therewithin and a movable arm affixed to said cylinder, said elbow harness being connected to said arm.

* * * * *